United States Patent [19]

Parchment et al.

[11] Patent Number: 4,734,952

[45] Date of Patent: Apr. 5, 1988

[54] CLEANING APPARATUS FOR GOLF CLUBS

[75] Inventors: James J. Parchment, 30851 Emperor Dr., P.O. Box 7323, Canyon Lake, Calif. 92380; Jerry W. Parker, Fountain Valley, Calif.

[73] Assignee: James J. Parchment, Canyon Lake, Calif.

[21] Appl. No.: 865,525

[22] Filed: May 21, 1986

[51] Int. Cl.[4] ..... B08B 1/00

[52] U.S. Cl. ..... 15/104.92; 15/160; 15/21 B

[58] Field of Search ..... 15/104.92, 104.5, 160, 15/21 B, 21 D

[56] References Cited

U.S. PATENT DOCUMENTS 3,583,018 6/1971 Fink ..... 15/104.92
3,872,534 3/1975 Hoag ..... 15/21 B
4,380,839 4/1983 Caradonna ..... 15/104.92
4,384,384 5/1983 Trojohn ..... 15/160 X

*Primary Examiner*—Louis K. Rimrodt
*Assistant Examiner*—J. L. Olds
*Attorney, Agent, or Firm*—Kelly, Bauersfeld & Lowry

[57] ABSTRACT

A cleaning apparatus for golf clubs includes an open-top tub for holding a cleaning solution, and brushes within the tub for removing dirt and grass from a golf club head when inserted into the tube between the brushes. The tub is provided a drain near its lower end to facilitate removal of the cleaning solution. A gasket is placed over the open upper-end of the tub, and is provided several flaps which permit a golf club head to be passed through the gasket and into the tube interior for cleaning, and yet tend to retain the cleaning solution within the tub interior by forming a barrier to outward passage of the cleaning solution.

13 Claims, 2 Drawing Sheets

CLEANING APPARATUS FOR GOLF CLUBS

BACKGROUND OF THE INVENTION

This invention relates generally to golfing accessories, and, more specifically, to an apparatus for cleaning mud, dirt and grass from the head of a golf club.

Many people enjoy the game of golf as it affords them an opportunity, among other things, to get outdoors and socialize with friends. Further, golf is a game of skill which virtually all ages can play and enjoy.

A problem often encountered during play is that the golfer's clubs and balls sometimes get coated with mud, dirt and/or grass in the normal course of events. Unless cleaned, golf balls will tend not to travel as far or as accurately as the player may desire, and thus unnecessrily limit the player's game. Because of this, many golf courses now provide ball cleaners at selected tees.

Until recently, there has been no convenient method or apparatus for cleaning golf club heads of dirt and grass which can accummulate during the normal course of a game. Previously when the need arose, golfers simply wiped mud and the like from the golf club head with rags, their fingers, and in some cases by even scraping the clubs against the grass, bushes or trees found along the course. It should be apparent that such cleaning methods have not proven to be entirely satisfactory, but in the absence of a better alternative, they have had to do.

Accordingly, there has been a need for a cleaning apparatus for golf clubs which is lightweight, inexpensive, durable, and can be either carried with the golfer during the game or conveniently mounted on a golf cart or the like. Such a cleaning apparatus must be sufficiently versatile to be able to clean iron-type clubs as well as wood-type clubs, and do so without requiring the golfer to directly contact the cleaning solution. Further, there has been a need for a golf club cleaning apparatus which, in addition to the foregoing, can itself be conveniently drained, disassembled and cleaned. The present invention fulfills these needs and provides other related advantages.

SUMMARY OF THE INVENTION

The present invention resides in a novel cleaning apparatus for golf clubs which can be economically manufactured of highly durable materials to provide a golfer a convenient means for cleaning all sizes of golf club heads as needed. The novel cleaning apparatus comprises, generally, an open-top container for holding a cleaning solution, and means for scrubbing a golf club head inserted into the container to remove mud, dirt and/or grass. Also provided is means for retaining the cleaning solution within the container, which retaining means simultaneously permits passage of a golf club head therethrough for placement into the cleaning solution.

In a preferred form of the invention, the open-top container is a box-like tub which includes four generally vertical sidewalls extending upwardly from an integrally molded base. One of these sidewalls has a drain passageway situated near its lower end, and the integrally molded base provides a supporting flange extending peripherally outwardly from the intersection of the vertical sidewalls and the base to provide means for attaching the cleaning apparatus to another structure.

A drain plug is provided which is removably insertable into the drain passageway to prevent the escape of the cleaning fluids placed into the tub. A drain plug guard is integrally molded into the tub adjacent the drain passageway to prevent an accidental dislodgement of the drain plug when a golf club head is inserted into the tub.

The scrubbing means includes a pair of oppositely facing brushes situated within the tub to scrub substantially all of the exposed surfaces of the golf club head inserted into the tub. Each of these brushes includes a backing member disposed adjacent one of the vertical sidewalls, which in turn supports a plurality of bristles preferably having two primary lengths to accommodate and satisfactorily scrub most different types of golf club heads.

The retaining means includes a flexible gasket situated to rest upon the upper edges of the four sidewalls and in a plane generally parallel to the plane of the base. This flexible gasket defines, in connection with the sidewalls and the base, an interior of the tub. The gasket includes a plurality of gasket flaps which are arranged to retain cleaning solution within the tub interior, yet permit the golf club head to be passed through the gasket for insertion into or withdrawal from the tub interior.

The retaining means further includes a top plate overlying the periphery of the gasket to sandwich the gasket between the top plate and the upper edges of the tub sidewalls. This top plate is then fastened to the tub in a manner preventing dislodgement of the gasket from between the top plate and the sidewalls. The top plate of the presently preferred embodiment can be advantageously removed from the tub to permit disassembly of the gasket from the tub and to permit removal of the brushes from the tub interior.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
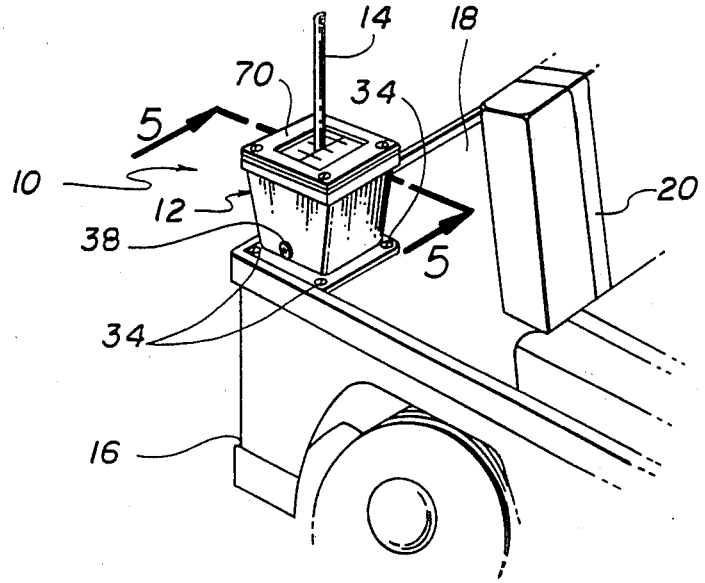
FIG. 1 is a perspective view of a cleaning apparatus for golf clubs embodying the invention and shown as it might be mounted on a golf cart or the like, the cleaning apparatus further being illustrated with a golf club shaft extending therefrom.
Figure 2:
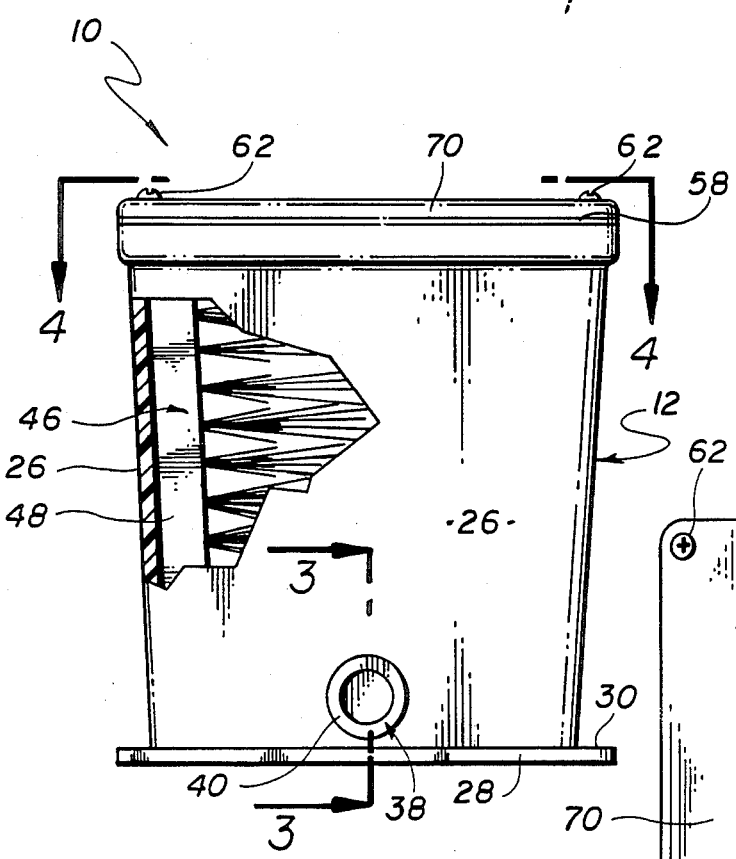
FIG. 2 is an enlarged elevational view of the cleaning apparatus illustrated in FIG. 1, having a portion of a tub sidewall broken away to illustrate the positioning of a brush within the tub.

As shown in the drawings for purposes of illustration, the present invention is concerned with a cleaning apparatus for golf clubs, generally designated in the accompanying drawings by the reference number 10. This novel cleaning apparatus 10 broadly comprises a box-like tub 12 for holding a cleaning solution therein, and means for scrubbing the head of a golf club 14. A retaining means is further situated to overlie an open top of the tub 12 to retain cleaning solution within the tub, yet permit passage of the head of the golf club 14 therethrough for placement into the cleaning solution.

The novel cleaning apparatus 10 of the present invention is designed to be lightweight, inexpensive, durable, and is constructed to be either carried around with the golfer during the game, or conveniently mounted on a golf cart 16 or the like. As illustrated in FIG. 1, the apparatus 10 of the present invention could be mounted to the rear upper surface 18 of the golf cart 16, rearward of the golf cart seat 20. Further, the novel cleaning apparatus 10 of the present invention is capable of cleaning both an iron-type golf club head 22 as well as a wood-type of golf club head 24, and do so without requiring the golfer to contact the cleaning solution. The illustrated apparatus 10 can itself be conveniently drained, disassembled and cleaned as needed.

In accordance with the present invention, and as illustrated with respect to a preferred embodiment in FIGS. 1–6, the box-like tub 12 includes four generally vertical sidewalls 26 extending upwardly from an integrally molded base 28. These sidewalls 26 and the base 28 are preferably formed of an ABS, high impact resistant plastic. The base 28 includes a peripheral flange 30 extending generally horizontally outwardly from the intersection between the sidewalls 26 and the base 28, to provide means for attaching the cleaning apparatus 10 to another structure, such as the golf cart 16. A plurality of apertures 32 are provided through this flange 30 to permit such attachment to be effected by screws 34 or the like.

Figure 3:
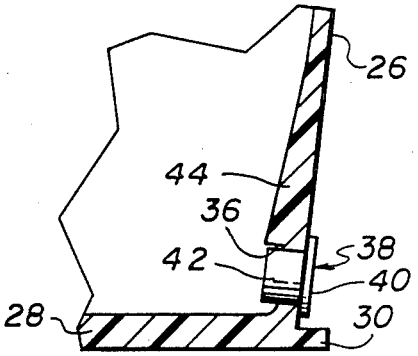
FIG. 3 is an enlarged, fragmented vertical section taken generally along the line 3—3 of FIG. 2, illustrating the manner in which a drain plug is normally positioned within a drain passageway, and further illustrating the construction of the adjacent tub sidewall to provide a drain plug guard.

An aperture 36 is provided through one of the sidewalls 26 near its intersection with the base 28, to provide a drain passageway for any cleaning fluids placed within the tub 12. As best illustrated in FIG. 3, a drain plug 38, having a body 40 and an expanded head 42, is normally positioned within and over the drain passageway aperture 36 to seal the same. To help prevent the accidental dislodgement of the drain plug 38 from the aperture 36 when the golf club 14 is inserted into the tub, a portion 44 of the sidewall 26 adjacent the drain passageway aperture 36 is thickened to provide a drain plug guard. The cross-sectional thickness of this sidewall portion 44 is preferably sufficient at its lower end so that as the golf club head 22 or 24 is inserted into the tub 12, that head is not allowed to impact directly against the body 40 of the drain plug 38 and force it outwardly through the drain passageway aperture 36.

The srubbing means mentioned above comprises a pair of brushes 46 positioned within the tub 12 in a manner designed to scrub all of the exposed surfaces of the golf club heads 22 and 24 which may be inserted into the tub. Each of these brushes 46 includes a backing member 48 disposed adjacent one of the vertical sidewalls 26 which is perpendicular to the vertical sidewall having the drain passageway aperture 36 therethrough. These backing members 48 each support a plurality of long bristles 50 and short bristles 52 which are generally uniformly disposed along the inwardly facing surface of the backing members 48. With this arrangement, the bristles from the oppositely facing brushes 46 are positioned to scrub mud, dirt and grass from an inserted golf club head, and yet are not so closely packed together to prevent a larger wood-type golf club head 24 from being cleaned therebetween as well as the smaller iron-type golf club head 22.

Opposite their intersection with the base 28, the sidewalls 26 form an integral upper peripheral ledge 54 which defines the upper edge of the box-like tub 12. This ledge 54 has an upper planar surface 56 on top of which a gasket 58 may be placed. At each intersecting corner of the sidewalls 26, the ledge 54 further supports a threaded insert 60 intended to receive a screw 62.

Figure 4:
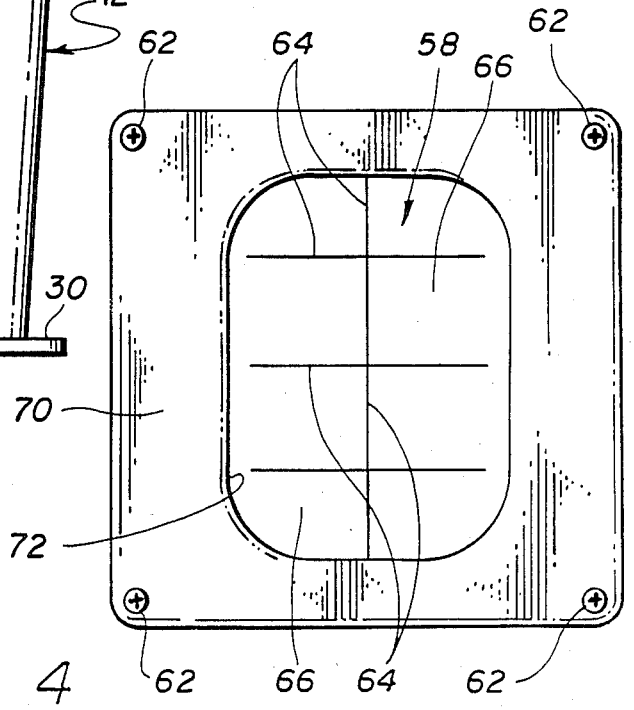
FIG. 4 is a top plan view of the cleaning apparatus, taken generally along the line 4—4 of FIG. 2.
Figure 5:
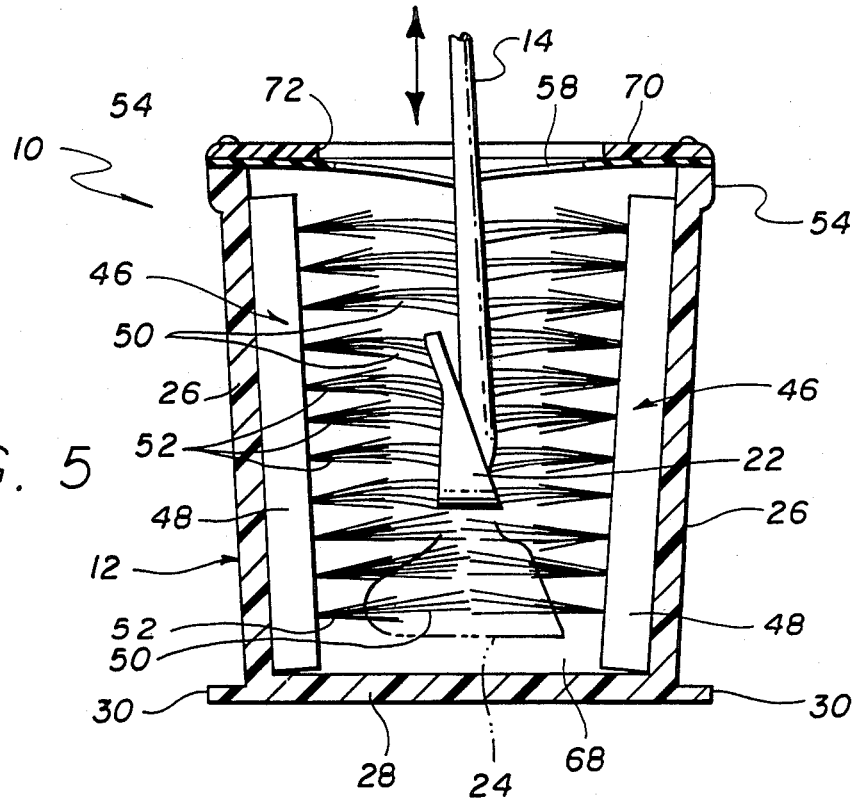
FIG. 5 is an enlarged vertical section taken generally along the line 5—5 of FIG. 1, illustrating the manner in which an iron-type golf club head would be cleaned by the brushes within the tub, and further illustrating in a similar fashion the manner in which a wood-type golf club head would be likewise cleaned, the wood-type head being illustrated in phantom.
Figure 6:
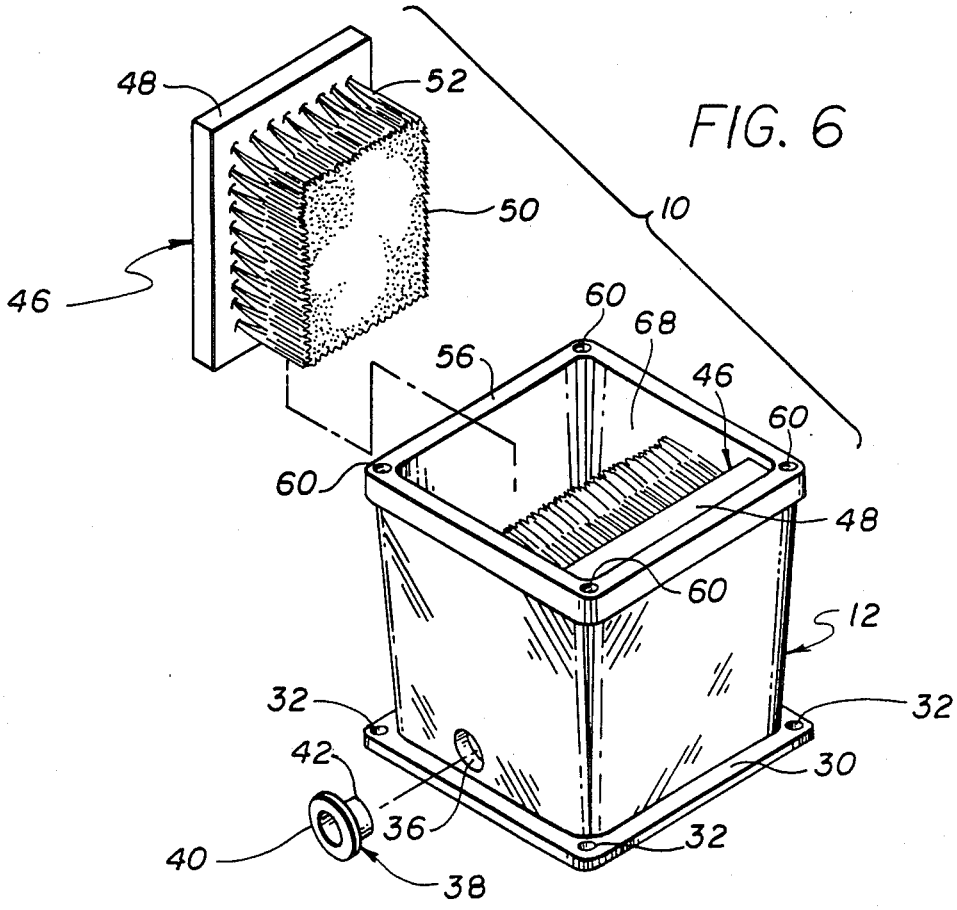
FIG. 6 is an exploded view of components of the cleaning apparatus of the present invention, illustrating a brush and the drain plug removed from the tub.

As best illustrated in FIGS. 4 and 5, the gasket 58 can be constructed of any suitable flexible material, and includes a series of slits 64 which form a plurality of movable gasket flaps 66. These gasket flaps 66 are so arranged as to retain a cleaning solution within the interior 68 of the tub 12, and yet permit either an iron-type golf club head 22 or a wood-type golf club head 24 to be passed through the gasket 58 for insertion into or withdrawal from the tub interior 68. For this purpose it is preferred that eight such gasket flaps 66 be provided (as illustrated in FIG. 4).

A top plate 70 having outer dimensions generally corresponding to the outer dimensions of the ledge planar surface 56 is situated above the gasket 58 to clamp the gasket between the tub 12 and the top plate. This top plate 70 is provided an enlarged aperture 72 of sufficient size to permit passage of the golf club heads 22 and 24 through both it and the gasket flaps 66. The purpose of this top plate 70 is to form a solid clamping means which can be tightly fastened to the tub 12 by the screws 62 to sandwich the periphery of the gasket 58 and hold the same in a manner preventing dislodgement.

To assemble the novel cleaning apparatus 10 of the present invention, the brushes 46 are inserted within the tub 12 so that the bristles 50 and 52 of the different brushes face each other, and the drain plug 38 is inserted into the drain passageway aperture 36. Next it is generally preferably to position the gasket 58 upon the upper ledge 54 of the tub 12, and sandwich the same between the top plate 70 and the ledge planar surface 56. Once the gasket 58 has been so positioned, then assembly of the cleaning apparatus 10 can be completed by simply turning the screws 62 into the threaded inserts 60 until the top plate 70 is sufficiently tightly fastened to prevent any dislodgement of the gasket 58. This assembled cleaning apparatus 10 can then be conveniently and easily used by a golfer either attached or unattached to another structure, such as the golf cart 16.

In explaining use of the cleaning apparatus 10, reference is made to FIG. 5 wherein an iron-type golf club head 22 is shown inserted through the gasket 58 and between the bristles 50. All that need be done to satisfactorily clean the golf club head 22 is to vigorously move the golf club head 22 up and down within the interior 68 of the tub 12 to dislodge the mud, dirt or grass which has become attached to the surface of the golf club head. It is preferable that a cleaning solution also be placed within the interior 68 of the tub 12 to compliment the scrubbing action of the long bristles 50. The amount of cleaning solution within the tub interior 68 should be such that insertion of a golf club head into the solution will not cause the same to overflow out of the tub 12.

When a wood-type golf club head 24 (illustrated in phantom in FIG. 5) is to be cleaned utilizing the cleaning apparatus 10 of the present invention, it is inserted and cleaned by both the long and short bristles 50 and 52 in a manner substantially identical to that described above in connection with the iron-type golf club head 22. It should be noted that the provision of uniformly spaced long and short bristles 50 and 52 enhance the utility of the cleaning apparatus 10 by permitting insertion of the much larger wood-type head 24 within the apparatus, while also accepting and satisfactorily cleaning the much smaller iron-type golf club heads 22.

From the foregoing it is to be appreciated that the novel cleaning apparatus 10 can be manufactured inexpensively from durable materials to form a high-quality product. The cleaning apparatus 10 can satisfactorily clean both iron-type golf club heads and wood-type golf club heads through the provision of oppositely facing brushes 46 having uniformly spaced long bristles 50 and short bristles 52. Further, the provision of a plurality of gasket flaps 66 insures that all types of golf club heads can be inserted into the interior 68 of the tub 12, while simultaneously preventing needless sloshing and splash-through of the cleaning solution from the tub interior as the cleaning apparatus is moved. Moreover, due to the specific construction of the novel cleaning apparatus 10, it may be conveniently mounted to another structure such as a golf cart 16, or used by simply placing it on the ground, holding it securely between the golfer's feet, and scrubbing the golf club heads as described above.

Although a particular embodiment of the invention has been described in detail for purposes of illustration, various modifications may be made without departing from the spirit and scope of the invention. Accordingly, the invention is not to be limited, except as by the appended claims.

I claim:

1. A cleaning apparatus for golf clubs, comprising:

a box-like tub for holding a cleaning solution, the tub including four generally vertical sidewalls extending upwardly from an integrally molded base, a first sidewall having an aperture therethrough situated near its lower edge to provide a drain passageway for the cleaning apparatus, the integrally molded base providing a supporting flange extending peripherally outwardly from the intersection of the vertical sidewalls and the base to provide means for attaching the cleaning apparatus to another structure;

a drain plug removably insertable into the sidewall aperture to prevent the escape of cleaning fluids from the tub through the drain passageway;

a drain plug guard integrally molded into the tub adjacent the sidewall aperture, wherein the first sidewall includes a thickened portion immediately above and adjacent the sidewall aperture which substantially covers the drain plug when inserted into the sidewall aperture to prevent a golf club head from impacting directly against the drain plug and dislodging the same when the golf club head is inserted into the tub;

a pair of oppositely facing brushes situated within the tub to scrub substantially all exposed surfaces of a golf club head inserted into the tub, each brush including a backing member disposed adjacent one of the vertical sidewalls, which supports a plurality of bristles having two primary lengths to accommodate and satisfactorily scrub most different types of golf club heads;

a flexible gasket situated to rest upon the upper edges of the four generally vertical sidewalls, the gasket lying in a plane generally parallel to the plane of the base and defining, in connection with the vertical sidewalls and the integrally molded base, an interior of the tub, the gasket including a plurality of gasket flaps so arranged as to retain cleaning solution within the tub interior, yet pemitting a golf club head to be passed therethrough for insertion into or withdrawal from the tub interior;

a top plate overlying the periphery of the gasket to sandwich the gasket between the top plate and the upper edges of the four generally vertical sidewalls; and means for fastening the top plate to the tub in a manner preventing dislodgment of the gasket from between the top plate and the upper edges of the four generally vertical sidewalls.

2. A cleaning apparatus as set forth in claim 1, wherein the fastening means is removable to permit disassembly of the top plate and gasket from the tub.

3. A cleaning apparatus as set forth in claim 2, wherein the brushes are removable from the tub for cleaning or replacement.

4. A cleaning apparatus for golf clubs, comprising:

an open-top tub for holding a cleaning solution, the tub including four generally vertical sidewalls extending upwardly from an integrally molded base, and a drain passageway through a first sidewall and adjacent the base;

a drain plug removably insertable into the drain passageway;

means for preventing an accidental dislodgment of the drain plug when a golf club head is inserted into the tub, the preventing means including a thickened portion of the first sidewall immediately above and adjacent the drain passageway, which thickened portion substantially covers the drain plug when inserted into the drain passageway to prevent a golf club head from impacting directly against the drain plug and dislodging the same when the golf club head is inserted into the tub;

a plurality of oppositely facing brushes situated within the tub to scrub substantially all exposed surfaces of a golf club head inserted into the tub;

a flexible gasket having at least a portion thereof situated to overlie the open top of the tub to provide means for retaining the cleaning solution within the tub, yet permitting passage of a golf club head therethrough; and means for securing the gasket over the top of the tub.

5. A cleaning apparatus as set forth in claim 4, wherein the intergrally molded base includes a supporting flange extending peripherally outwardly from the intersection of the vertical sidewalls and the base to provide means for attaching the cleaning apparatus to another structure.

6. A cleaning apparatus as set forth in claim 4, wherein each of the plurality of oppositely facing brushes includes a backing member disposed adjacent a substantially vertical sidewall of the tub, which backing member supports a plurality of cleaning bristles.

7. A cleaning apparatus as set forth in claim 6, wherein the cleaning bristles have two primary lengths to accommodate and satisfactorily scrub most different types of golf club heads when inserted into the tub.

8. A cleaning apparatus as set forth in claim 4, wherein the flexible gasket is situated to rest upon the upper edges of the four generally vertical sidewalls, the gasket further lying in a plane generally parallel to the plane of the base and defining, in connection with the vertical sidewalls and the integrally molded base, an interior of the tub.

9. A cleaning apparatus a set forth in claim 8, wherein the gasket includes a plurality of gasket flaps so arranged as to retain cleaning solution within the tub interior, yet permitting a golf club head to be passed therethrough for insertion into or withdrawal from the tub interior.

10. A cleaning apparatus as set forth in claim 4, wherein the securing means includes a top plate overlying the periphery of the gasket to sandwich the gasket between the top plate and the open top of the tub.

11. A cleaning apparatus as set forth in claim 10, further including a means for fastening the top plate to the tub in a manner preventing dislodgement of the gasket from between the top plate and the tub.

12. A cleaning apparatus for the heads of different types of golf clubs, comprising:

a box-like tub for holding a cleaning solution, the tub including four generally vertical sidewalls extending upwardly from an integrally molded base, a first sidewall having a passageway therethrough situated adjacent the base to provide a drain for the cleaning apparatus, the integrally molded base providing a supporting flange extending peripherally outwardly from the intersection of the vertical sidewalls and the base to provide means for attaching the cleaning apparatus to another structure;

a drain plug insertable into and frictionally retained within the drain passageway to prevent the escape of cleaning fluids from the tub through the drain passageway;

a drain plug guard integrally molded into the first sidewall, wherein the first sidewall includes a thickened portion immediately above and adjacent the drain passageway, which thickened portion substantially covers the drain plug when inserted into the drain passageway to prevent a golf club head from impacting directly against the drain plug and dislodging the same when the golf club head is inserted into the tub;

a pair of oppositely facing brushes situated within the tub to scrub substantially all exposed surfaces of the golf club head inserted into the tub, each brush including a backing member disposed adjacent one of the vertical sidewalls, the backing members each supporting a plurality of long bristles and short bristles uniformly disposed along the inwardly facing surface of the backing members, wherein the long bristles are capable of adequately cleaning mud, dirt and grass from an inserted golf club iron head, but are not so closely packed together to prevent a larger wood-type golf club head from being inserted between the brushes for cleaning by the short bristles as well as the long bristles;

a flexible gasket situated to rest upon the upper edges of the four generally vertical sidewalls, the gasket lying in a plane generally parallel to the plane of the base and defining, in connection with the vertical sidewalls and the integrally molded base, an interior of the tub, the gasket including a plurality of gasket flaps so arranged as to retain the cleaning solution within the tub interior, yet permitting a golf club head to be passed therethrough for insertion into or withdrawal from the tub interior;

a top plate overlying the periphery of the gasket to sandwich the gasket between the top plate and the upper edges of the four generally vertical sidewalls; and means for fastening the top plate to the tub in a manner preventing dislodgment of the gasket from between the top plate and the upper edges of the four generally vertical sidewalls.

13. A cleaning apparatus as set forth in claim 1, wherein each brush includes a plurality of long bristles and short bristles uniformly extending from the backing member, wherein a golf club iron head may be placed between the oppositely facing brushes and adequately cleaned of mud, dirt and grass by the long bristles, which long bristles are not so closely packed together to prevent a larger wood-type golf club head from being positioned between the oppositely facing brushes and cleaned by the short bristles in connection with the long bristles.

* * * * *

UNITED STATES PATENT AND TRADEMARK OFFICE

CERTIFICATE OF CORRECTION

PATENT NO. : 4,734,952

DATED : April 5, 1988

INVENTOR(S) : James J. Parchment, et al.

It is certified that error appears in the above-identified patent and that said Letters Patent is hereby corrected as shown below:

In the Abstract, line 4, delete the word "tube" and insert therefor --tub--.

In the Abstract, line 9, delete the word "tube" and insert therefor --tub--.

In Column 4, line 49, delete the word "preferably" and insert therefor --preferable--.

In Column 7, line 23, delete the word "a" between the words "including" and "means."

Signed and Sealed this

Fourth Day of October, 1988

*Attest:*

DONALD J. QUIGG

*Attesting Officer*

*Commissioner of Patents and Trademarks*